US008807340B2

(12) United States Patent
Zimmer

(10) Patent No.: US 8,807,340 B2
(45) Date of Patent: Aug. 19, 2014

(54) BEVERAGE GLASS AND BEVERAGE GLASS ASSEMBLY

(75) Inventor: Matt Zimmer, Newport Beach, CA (US)

(73) Assignee: STACKED Wines, LLC, Anaheim, CA (US)

( * ) Notice: Subject to any disclaimer, the term of this patent is extended or adjusted under 35 U.S.C. 154(b) by 29 days.

(21) Appl. No.: 13/111,454

(22) Filed: May 19, 2011

(65) Prior Publication Data

US 2013/0221009 A1 Aug. 29, 2013

(51) Int. Cl.
*B65D 21/032* (2006.01)

(52) U.S. Cl.
USPC ..... 206/509

(58) Field of Classification Search
USPC ..... 206/499, 501, 502, 503, 505, 507, 217, 206/509, 515, 519, 520; 220/359.1, 703; 215/6, 10
See application file for complete search history.

(56) References Cited

U.S. PATENT DOCUMENTS

| | | | | |
|---|---|---|---|---|
| D140,658 | S | 3/1945 | Erbe | |
| 2,539,514 | A | 1/1951 | Jenett | |
| 2,738,891 | A * | 3/1956 | Pitto | 215/10 |
| 2,747,387 | A | 5/1956 | Sweem | |
| 3,006,461 | A | 10/1961 | McGinnis | |
| 3,198,327 | A | 8/1965 | Boehling et al. | |
| 3,243,068 | A * | 3/1966 | Huston | 215/10 |
| 3,393,819 | A | 7/1968 | Van De Walle et al. | |
| 3,482,731 | A * | 12/1969 | Douty | 220/630 |
| 3,542,230 | A * | 11/1970 | Campbell et al. | 215/10 |
| 3,561,668 | A * | 2/1971 | Bergstrom | 229/123.1 |
| 3,684,123 | A * | 8/1972 | Bridges | 206/503 |
| 3,881,437 | A | 5/1975 | Lovell et al. | |
| 3,920,142 | A | 11/1975 | Vandrebeck et al. | |
| D242,416 | S | 11/1976 | Achenbach | |
| 4,382,506 | A | 5/1983 | Chaussadas | |
| 4,410,102 | A | 10/1983 | Lutzker | |
| 4,610,349 | A | 9/1986 | Schwartz et al. | |
| 4,679,699 | A | 7/1987 | Malsbury et al. | |
| 4,681,225 | A | 7/1987 | Schuster | |
| 4,685,565 | A | 8/1987 | Sparling | |
| 4,699,290 | A | 10/1987 | Adams | |
| 4,712,707 | A | 12/1987 | Pavely | |
| 4,848,579 | A * | 7/1989 | Barnes et al. | 206/508 |

(Continued)

FOREIGN PATENT DOCUMENTS

| | | |
|---|---|---|
| GB | 1019346 | 2/1966 |
| GB | 2303114 A | 12/1997 |

OTHER PUBLICATIONS

U.S. Appl. No. 29/411,983, filed Jan. 27, 2012, Zimmer.
U.S. Appl. No. 13.474,376, filed May 17, 2012, Zimmer.

(Continued)

*Primary Examiner* — Andrew Perreault
(74) *Attorney, Agent, or Firm* — Brinks Gilson & Lione

(57) ABSTRACT

A gas dissolving apparatus that combines a gas at first pressure into a working fluid, the working present at a second pressure equal to or greater than the first pressure. The device includes a molecular mixing chamber which is designed as a truncated conical chamber located between an inlet and an outlet. The device can include a plurality of inlets for the gas to enter into the mixing section, and a plurality of passages through the truncated conical chamber. The truncated conical chamber is surrounded by a cylindrical chamber leading to the outlet of the chamber.

15 Claims, 7 Drawing Sheets

(56) References Cited

U.S. PATENT DOCUMENTS

| | | | | |
|---|---|---|---|---|
| 5,054,640 | A | 10/1991 | Tucker | |
| 5,110,002 | A | 5/1992 | Tucker | |
| 5,203,467 | A | 4/1993 | Tucker | |
| 5,240,132 | A | 8/1993 | Tucker | |
| 5,279,841 | A | 1/1994 | Yu | |
| D347,763 | S | 6/1994 | Kleckauskas et al. | |
| 5,452,818 | A | 9/1995 | Yost | |
| D368,311 | S | 3/1996 | Cockram | |
| D384,280 | S | 9/1997 | Kuczer | |
| 5,709,314 | A * | 1/1998 | Petry | 220/802 |
| D403,957 | S | 1/1999 | Bright et al. | |
| D404,256 | S | 1/1999 | Asberg | |
| 5,860,527 | A * | 1/1999 | Frankenberg et al. | 206/509 |
| D409,444 | S | 5/1999 | Pelz et al. | |
| 5,904,430 | A * | 5/1999 | Alessi | 220/4.27 |
| 5,984,127 | A | 11/1999 | Fenton | |
| 6,065,603 | A | 5/2000 | Filice et al. | |
| D479,436 | S | 9/2003 | Ortiz | |
| D484,361 | S | 12/2003 | Jeung | |
| 6,820,743 | B2 | 11/2004 | Hurley et al. | |
| D519,783 | S | 5/2006 | Lambert et al. | |
| D540,621 | S | 4/2007 | Wahl | |
| D547,201 | S | 7/2007 | Zeller | |
| D547,202 | S | 7/2007 | Herzog et al. | |
| D547,203 | S | 7/2007 | Herzog et al. | |
| D551,502 | S | 9/2007 | Bodum | |
| 7,273,147 | B2 | 9/2007 | Willat et al. | |
| D575,108 | S | 8/2008 | Barducci | |
| D577,547 | S | 9/2008 | Willat et al. | |
| D582,213 | S | 12/2008 | Kehrein et al. | |
| D595,096 | S | 6/2009 | Slay | |
| D640,900 | S | 7/2011 | Jesseph | |
| D644,938 | S | 9/2011 | Saunders et al. | |
| 8,328,014 | B2 | 12/2012 | Saunders et al. | |
| 8,336,726 | B2 | 12/2012 | Ramsey et al. | |
| D674,236 | S | 1/2013 | Zimmer | |
| D674,237 | S | 1/2013 | Zimmer | |
| D674,238 | S | 1/2013 | Zimmer | |
| D674,243 | S | 1/2013 | Zimmer | |
| 2001/0032795 | A1 | 10/2001 | Weinstein et al. | |
| 2003/0029891 | A1 | 2/2003 | Alexander | |
| 2003/0221987 | A1 | 12/2003 | Trude | |
| 2005/0092759 | A1 | 5/2005 | Willat et al. | |
| 2005/0139570 | A1 | 6/2005 | Lambert et al. | |
| 2006/0032855 | A1 | 2/2006 | Hinkle | |
| 2007/0012693 | A1 | 1/2007 | Kummer | |
| 2007/0119726 | A1 | 5/2007 | Willat et al. | |
| 2007/0144932 | A1 | 6/2007 | Willat et al. | |
| 2007/0193913 | A1 | 8/2007 | Schroeder | |
| 2008/0011748 | A1 | 1/2008 | Meyer et al. | |
| 2008/0023347 | A1 | 1/2008 | Wahl et al. | |
| 2008/0023348 | A1 | 1/2008 | Herzog et al. | |
| 2008/0047865 | A1 | 2/2008 | Willat et al. | |
| 2008/0083639 | A1 | 4/2008 | Peterman et al. | |
| 2008/0302692 | A1 | 12/2008 | Dubosq et al. | |
| 2009/0308771 | A1 | 12/2009 | Sparling et al. | |
| 2010/0025351 | A1 * | 2/2010 | Fowler | 215/10 |
| 2010/0072095 | A1 | 3/2010 | Salovaara | |
| 2010/0072164 | A1 | 3/2010 | Smith et al. | |
| 2010/0176022 | A1 | 7/2010 | Furlong | |
| 2010/0294770 | A1 | 11/2010 | Wing et al. | |
| 2010/0314274 | A1 * | 12/2010 | Saunders et al. | 206/499 |
| 2011/0132781 | A1 * | 6/2011 | Willat et al. | 206/217 |
| 2011/0174763 | A1 * | 7/2011 | Kennedy | 215/377 |
| 2012/0045554 | A1 | 2/2012 | Carvin et al. | |
| 2013/0062238 | A1 | 3/2013 | Saunders et al. | |

OTHER PUBLICATIONS

U.S. Appl. No. 29/423,510, filed Jun. 1, 2012, Zimmer.
U.S. Appl. No. 29/423,578, Jun. 1, 2012, Zimmer.
U.S. Appl. No. 29/423,581, Jun. 1, 2012, Zimmer.
"Royalty Free Stock Photos: Yogurt pack. Isolated," available at http://www.dreamstime,com/royalty-free-stock-photos-yoqurt-pack-isolated-imaqe127855298 as of May 10, 2013, two pages.
"Custom Stack of Four," available at http://www.shop.vervacious.com/Custom-Stack-of-Four-Stack4.htm;jsessionid=05A123C . . . as of May 10, 2013, one page.
"Vervacious," available at http://www.beachpackagingdesign.com/wp/2009/02/vervacious-love.html as of May 10, 20013, it is believed the design shown was publicly available at Vervacious as of Feb. 4, 2009, three pages.
"Hip Wine Glasses: Stack'em Up-PB Outdoor drinking glasses," available at http://www.dailyolive.com/2006/03/hip-wine-glass.html as of May 10, 2013, it is believed that glasses shown were publicly sold by Crate & Barrel as of Mar. 2006, two pages.
"Tableware—Spiegelau Authentis Beer Glasses," available at http://www.everten.com.au/Spiegelau-Authentis-Casual-Beer-Glasses.html as of May 10, 2013, two pages.
"Impilabile 250 ml Stacking Base Bottle," available at http://www.demijohn.co.uk.impilabile-250ml-stacking-bottle-base as of May 10, 2013, two pages.
"Double or Nothing—The Highland & Island Malt Whisky Stack," available at http://qearpatrol.com/2011/03/23/the-highland-island-malt-whisky-stack/ted-image127855298 as of May 10, 2013, it is believed to regard article published by Highland & Island on Mar. 23, 2011, seven pages.
"Clontarf Trinity Irish Whiskey," available at http://images.search.yahoo.com/search/images?_adv_prop=image&fr=yfp-t-900-s&va=clontarf+trinity+whiskey as of Apr. 29, 2013, one page.
"Dual Jar Tops the Competition," available at http://www.packworld.com/package-feature/safety/dual-jar-tops-ccompetition as of Apr. 29, 2013, six pages.
"Mystic 500ml Stacking Bottle," available at http://www.demijohn.co.uk/mystic-500ml-stacking-bottle as of Apr. 29, 2013, two pages.
"Stackable Bottle," available at http://www.alibaba.com/product-free/216252136/Stackable_Bottle.html as of Apr. 29, 2013, two pages.
"Recycled-Glass Stacking Bottles," available at http://www.westelm.com/products/recycled-glass-stacking-bottles-a912/ as of Apr. 29, 2013, two pages.
"Stackable Bottles Filled with Greek Extra Virgin Olive Oil," available at http://www.abovegourmet.com/ol104.htm as of Apr. 29, 2013, two pages.
"Sauce—IM-50PP-1008-FL15," available at http://www.plasdene.com.au/categorv/product/cat1/Food/cat2/Glass/cat3/Bottle/cat4/Sauce/total/24/page/1/code/IM-50PP-1008-FL15 as of Apr. 29, 2013, one page.
"Personalised Gifts—Products—Stackable Bottles," available at http://www.marronliqueurs.co.uk/stackable-bottles as of Apr. 29, 2013, two pages.
Search results regarding trademark registration 2,996,209 regarding trademark pertaining to two stacked jars that were in commerce as of Sep. 26, 2004, three pages.
Search results regarding trademark registration 3,119,824 regarding trademark pertaining to three interlocking bottles that were in commerce as of Sep. 2003, two pages.
Search results regarding trademark registration 3,197,750 regarding trademark pertaining to two stacked glass jars that were in commerce as of Oct. 25, 2004, three pages.

* cited by examiner

BEVERAGE GLASS AND BEVERAGE GLASS ASSEMBLY

BACKGROUND

The present invention is directed to a beverage container such as a wine glass that can be sealed with a seal or lid that can be removed prior to consumption. The present invention also relates to assemblies of multiple beverage containers in direct connected, attached configuration.

Beverages are commonly sold to consumers in containers such as glass or plastic bottles, aluminum or steel cans, cardboard or plastic cartons; or devices that include bladders containing the beverage. The beverage contained therein can be transferred to a suitable drinking glass composed of a suitable material including but not limited to glass, plastic, or the like for consumption. In certain situations, users prefer drinking beverages from individual serving containers such as cans, juice bottles and the like. However many consumers prefer drinking certain types of beverages from glasses having wide mouths to enhance the aroma and, therefore, the flavor of the beverage.

It would be desirable to provide individual servings of various beverages in sealed wide-mouth containers to enhance the aroma and taste of the beverage during consumption. It is also desirable to provide individual serving containers that can be positioned together into multi-serving container packages for sale or distribution.

SUMMARY

A beverage container is defined herein that includes a vessel body and a lid. The vessel body has a base, a side wall, and a rim that defines a chamber. The base has a defined perimeter. The side wall is connected to the base and extends upward therefrom. The rim is defined on the side wall distal from the base. The side wall has a side wall median located midway between the base and the rim. The side wall also has an outwardly projecting central section having a maximum circumference greater than the perimeter of the base. The maximum circumference of the side wall is located at a position on the side wall between the side wall median and the respective base or rim. The lid has a first face oriented toward the vessel body when the lid is on position relative to the vessel body and an opposed second face. A seal region is defined on the first face of the lid and at a location corresponding to the rim of the vessel body in releasable contact therewith.

An assembly of beverage containers as previously described. The assembly includes at least two beverage containers, each container having a vessel body and a lid. Each container has a beverage serving located in a sealed chamber defined in the vessel body and the attached lid. A base of at least one first beverage container releasably engages the rim of a second beverage container such that the lid of the second beverage container is interposed between the respective rim and base. The interposed lid is in sealed engagement with the second beverage container.

BRIEF DESCRIPTION OF THE DRAWINGS

The various features, advantages and other uses of the present apparatus will become more apparent by referring to the following detailed description and drawing in which.

DETAILED DESCRIPTION

Figure 1:
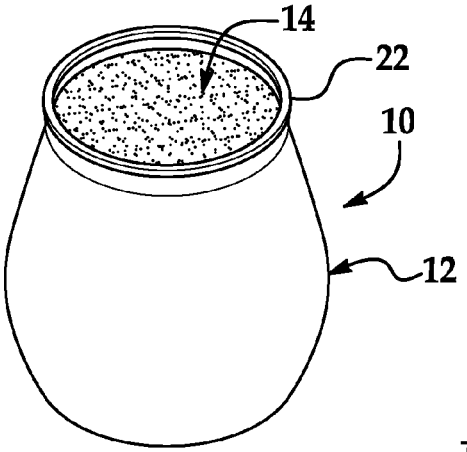
FIG. 1 is a perspective view of an embodiment of the beverage container as disclosed herein.

As shown in the exemplary drawing figures, and referring particularly for FIG. 1, a beverage container 10 includes a beverage vessel body 12 and a removable lid 14 sealingly affixed to the beverage vessel body 12. The beverage vessel body 12 can be constructed of any suitable material. In various embodiments, the beverage vessel body 12 can be made of a suitable moldable polymeric material. Where desired or required, the material can be transparent. In specific embodiments, the material employed can be any material that is suitable for use with food stuffs. The material can be one that is dimensionally stable but can provide minor deformation in specific applications. In applications where the beverage container 10 contains wine, the beverage vessel body 12 can be composed of a suitable transparent polymeric material. The lid 14 can be made of any suitable material including but not limited to foil, plastic and the like. The material employed in the lid 14 can be made of a material that is the same or different from the material of the vessel body 12. In some applications, it is contemplated that the material employed in the lid 14 will be more deformable than that employed in the vessel body 12 and will be able to conform to suitable dimensional contours by crimping or the like.

Figure 7:
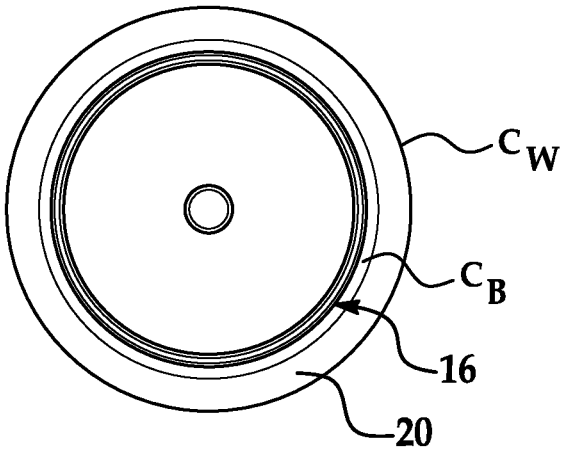
FIG. 7 is a bottom view of the beverage container of FIG. 1.

The beverage vessel body 12 includes a base 16 that has a circumference $C_B$ as measured at the outer perimeter of a surface contacting regions that has of a first defined value (see FIG. 7). The beverage vessel body 12 also has a side wall 20 that terminates in a rim 22. The side wall 20 and base 16 define a chamber of a specified volume. As such, the side wall 20 will have a suitable height H. The side wall also has a side wall median M.

In the embodiment depicted in the drawing figure, the side wall 20 has a curvilinear outer contour that creates at least one outwardly protecting bulbous region 24 that extends beyond the perimeter created by the base 16. The side wall 20 has an inwardly tapering region 26 immediately above bulbous region 24. Tapering region 26 terminates in rim 22, the geometry of which will be described in greater detail subsequently. In the embodiment depicted, the side wall 20 has bulbous region 24 located below the side wall height median M. Bulbous region 24 has a circumference $C_W$ greater than the circumference $C_B$ of base 16. The side wall 20 curves upward from base 16 to the circumference maxima at $C_W$. The side wall 20 then enters a gentle inward curve that proceeds contiguously into tapering region 26. Circumference maxima at $C_W$ can be any percentage greater than that of the circumference $C_B$ of base 16. In certain embodiments, it is contemplated that the circumference maxima $C_W$ can be between 10 and 50% greater than the circumference $C_B$ of base 16.

The side wall 20 has an inwardly tapering region 26 between the bulbous region 24 and the rim 22. In the embodiment depicted, the rim 22 has a circumference maxima $C_R$ equal to or less than the circumference $C_B$ of the base 16. In the embodiment depicted in the drawing figures, the outer circumference or circumference maxima $C_R$ of the rim 22 will be between 0 and 15% less than the circumference $C_R$ of base 16. In certain embodiments, the maximum circumference $C_W$ of side wall 20 will be between 5% and 50% greater than the circumference $C_B$ of base 16.

Side wall 20 can have a suitable inner face 28 opposed to a curvilinear outer face outer face 30. In certain various embodiments, the inner and outer faces will be parallel. Thus the internal chamber defined in vessel body 12 will have greater volume in the regions below the median M.

The internal volume of the vessel body 12 generally will be suitable to contain a suitable beverage serving. The vessel body will be proportioned in a manner that provides the suitable volume. In certain embodiments it is contemplated that the base 16 will have a cross-sectional diameter between 2 and 4 inches. The outer diameter of rim 22 will be sufficient to permit releasable engagement between rim 22 of one container 10 and base 16 of a second container. The inner diameter of the rim 22 will be sufficient to permit the beverage to be consumed from the vessel body 12. The maximum diameter of side wall 20 in the bulbous region 24 can be between ¼ inch and 1 inch greater than the diameter of base 16. The total height of the beverage container will be one that approximates the height of a 6 oz. beverage glass in certain applications.

Rim 22 is contiguously joined to the upper region of side wall 20. As depicted, rim 22 includes a body 32 with a lip 34 projecting axially outward therefrom to a defined distance. In the embodiment depicted in the drawing figures, the lip 34 extends to provide an outer surface that can be received in a suitable orifice defined in the base 16 of a corresponding beverage vessel. In certain embodiments, the outer diameter of rim 22 is essentially equal to an inner diameter defined by base 16. The rim 22 also has an upwardly oriented surface that can include at least one upwardly oriented surface or bead 36 projecting therefrom.

Figure 16A:
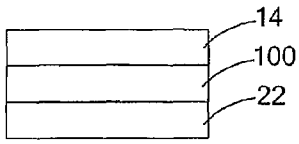
FIG. 16A schematically shows a material that adheres to a seal region of a beverage container of FIGS. 1 and 10.

Rim 22 is configured to be placed in mating contact with the lid 14 in a manner that facilitates establishment of a removed seal. Lid 14 can contact rim 22 in any suitable manner. In certain embodiments, the lid 14 is configured with a suitable edge region that is affixed to the rim 22 to maintain the beverage inside that vessel body 12. The lid 14 can be attached to the rim 22 in any suitable manner including, but not limited to crimping adhesives and the like. Where an adhesive material 100 is employed, the suitable adhesive material will be one that is suitable for use with food stuffs. Note that an adhesive material is inherently a material that includes an adhesive that is a sticky substance that can adhere or stick to another material. The adhesive material can be present as a layer, bead, or other structure that is interposed between the rim 22 and the interior facing side of lid 14. Where desired or required, the interposed adhesive can be positioned such that it contacts all or a portion of the upper surface of rim 22, such as bead 36. Note that adherence of the adhesive material 100 is schematically shown in FIG. 16A, wherein the items shown in FIG. 16A are not meant to be limited to a particular shape or dimension.

The lid 14 can have any suitable configuration to sealingly engage the rim 14 and span the opening defined in the vessel body 12. In various embodiments, the lid 14 can be a thin planar member that can conform to and cover the defined opening. When in sealing engagement, the lid 14 can deflect inward into the opening defined in the vessel body 12. The lid 14 can have a suitable peripheral region proximate to its outer edge that can be configured to conform to at least a portion of the rim 22, wherein the peripheral region can be thought of as a seal region.

The desired beverage can be sealed in the vessel body 12 by lid 14. The volume of beverage will be such that the height of the beverage comes to a suitable fill line F. When the vessel body is composed of a suitable transparent polymeric material, the beverage will be visible through the vessel body 12.

The rim 22 can have any configuration that will facilitate sealing engagement between the lid 14 and the vessel body 12. In the embodiment depicted, the rim 22 can be configured with a plurality of steps 40, 42 positioned on interiorly and exteriorly oriented surfaces relative to bead 36. It is contemplated that adhesives or other sealing material can be interposed between the interiorly oriented steps 40, 42 and lid 14. Note that an adhesive is inherently a material that is a sticky substance that can adhere or stick to another material. As used herein the term "adhere" is taken to include connection facilitated by direct rim-to-lid adhesion as well as interposition of a suitable adhesive layer 100 between the rim 22 and the lid 14 as shown in FIG. 16A. Where a line of adhesive is used, it is contemplated that the adhesive line can be deployed so as to contact the bead 36 of rim 22 and, if desired, the adhesive can be disposed such that the adhesive contacts multiple planar surfaces defined in the inwardly oriented surface of the rim 22.

It is also within the purview of this disclosure to configure lid 14 to conform to one or more of the geometric ridges and/or shelves defined in the upper surface of the rim 22. Conformance can be accomplished during manufacture of lid 14 or during attachment of lid 14 to associated rim 22. Conformance fitting may be augmented by adhesives where desired or required.

Figure 4:
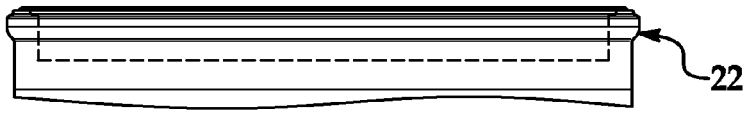
FIG. 4 is a detail view of an embodiment of a rim elevation of the beverage container of FIG. 1.
Figure 5:
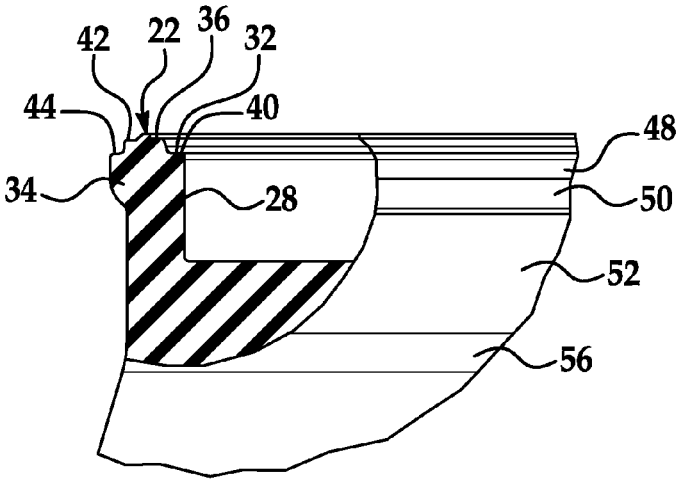
FIG. 5 is a cross-sectional view taken along the 5-5 line of FIG. 3.
Figure 6:
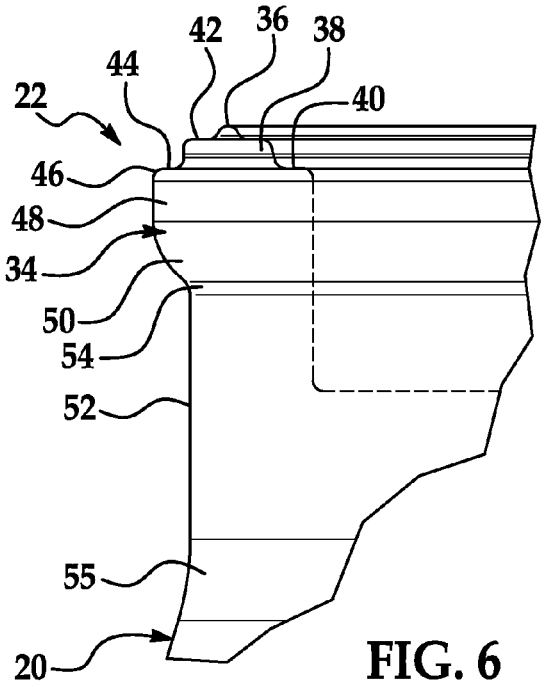
FIG. 6 is a detail view of an embodiment the rim portion of the beverage container of FIG. 1.

In the embodiment depicted in FIG. 4-6, the rim 22 has at least one shoulder 38 radially interior of the bead 36. The shoulder 38 is has a maximum height or peak below bead 36. Shelf 40 is located radially interior to shoulder 38 and is positioned contiguous thereto. Shelf 40 terminates in downwardly projecting inner wall 28.

Where desired or required, the rim 22 can have suitable outer geometric details. In the embodiment depicted in FIG. 4-6, the rim 22 has a shoulder 42 radially outward of bead 36 and positioned below the bead 36. A shelf 44 is positioned radially outward of the shoulder 42 and is contiguously joined to it. The contours of the various shelves 40, 44 and shoulders 38, 42 will be sufficient to permit contact with lid 14 but will be small enough to permit an enjoyable drinking experience.

The outer edge 46 of shelf 44 defines a downwardly extending wall region 48 that terminates in an inwardly curved lower region 50. In the embodiment depicted, the inwardly curved lower region 50 terminates in a cylindrical band portion 52 that is interposed between the rim 22 and the uppermost portion of side wall 20. Side wall 20 and cylindrical band portion 52 can be contiguous to one another or can have a suitable intermediate region 54 interposed between them. In the embodiment depicted in the various drawing figures, an inwardly tapered is interposed between the intermediate region 54 inwardly curved lower region 50 and the cylindrical band portion 52.

The vessel body 12 can also include a transitional region 55 interposed between band portion 52 and the upper region of side wall 20.

Figure 8:
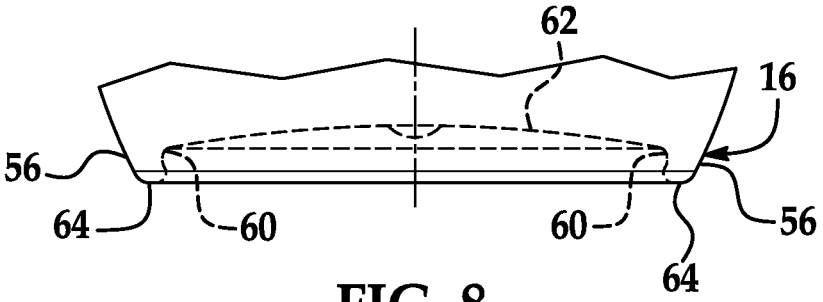
FIG. 8 is a detail view of the bottom region of the beverage container of FIG. 1
Figure 9:
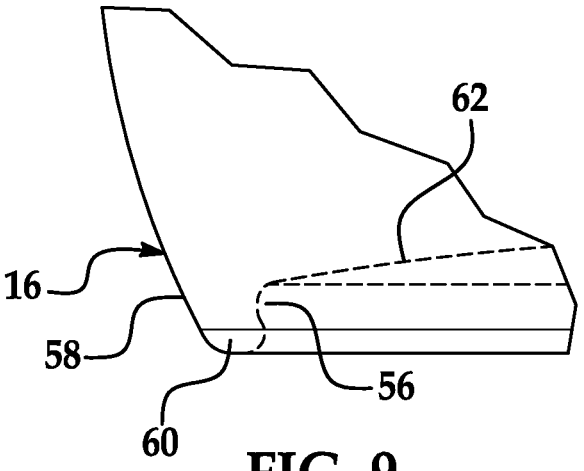
FIG. 9 is detail view of the lip region of the beverage container of FIG. 1.
Figure 10:
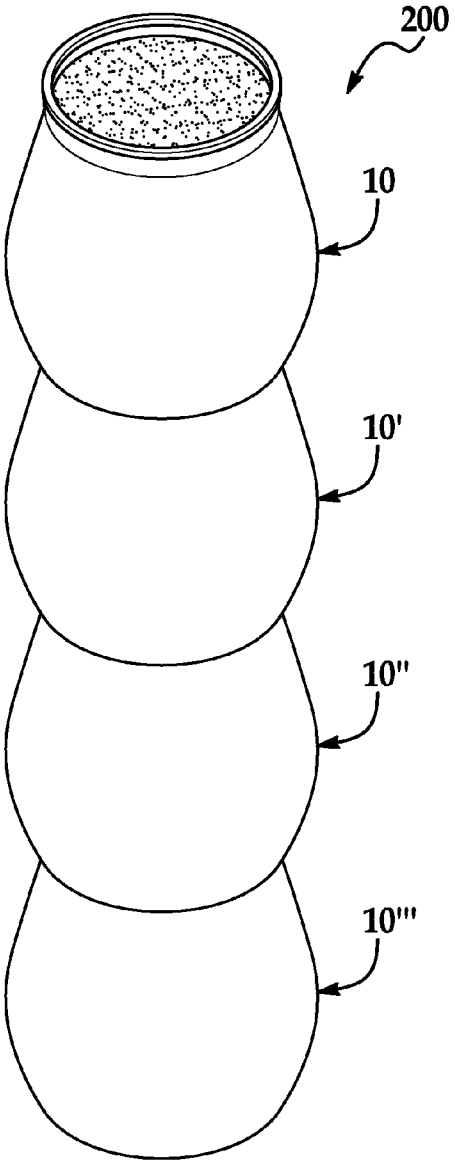
FIG. 10 is a perspective view an embodiment of a beverage container assembly as disclosed herein.

The base 16 of vessel body 12 can be configured to releasably engage with rim 22 of a similarly configured beverage vessel 10. In the embodiment depicted in the drawing figures, the base 16 includes at least one arm member 56 having an outwardly oriented side 58 contiguously connected to the lower region of the side wall 20 at a location on vessel body 12 opposed to the rim 22. The arm member 56 defines an inwardly oriented detent 60 generally opposed to outwardly oriented side 58 that terminates in bottom wall (shown in phantom in FIGS. 8 and 9). The size, number and positioning of arm member(s) 56 is that sufficient to releasably engage the rim 22 of a corresponding beverage container 10. As depicted in FIGS. 7, 8 and 9, the device has one arm member 56 that extends continuously around the circumference of the base 16 and defines a surface contacting region 64.

The detent 54 can have any suitable internal wall configuration sufficient to receive and maintain at least a portion of rim 22 of an associated beverage device 10 in engaged relationship. In the embodiment depicted, the internal wall of detent 60 has a concave configuration that can releasably engage the corresponding rim 22. In the embodiment depicted, the inner wall of detent 60 contacts the shoulder 50 associated with rim 22.

The arm member 56 can be either of solid or hollow construction depending on the specific application. In the embodiment depicted in the drawing figures, arm member 56 is a continuous solid circular body contiguously positioned relative to side wall 20 and bottom wall 62. Without being bound to any theory, it is believed that the solid continuous arm member 56 provides stability to the associated vessel body 12. It is further believed that solid continuous arm member 56, when employed with solid rim 22 as further associated with curve linear side wall 20 provides a structurally robust beverage container 10.

Figure 2:
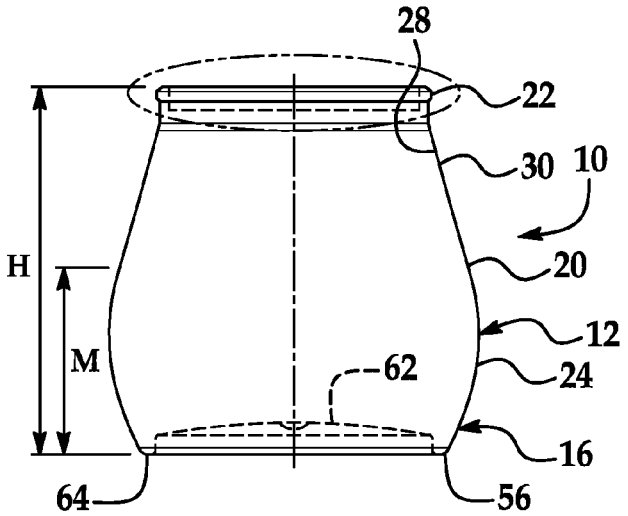
FIG. 2 is a side view of an embodiment of the beverage container of FIG. 1.
Figure 3:
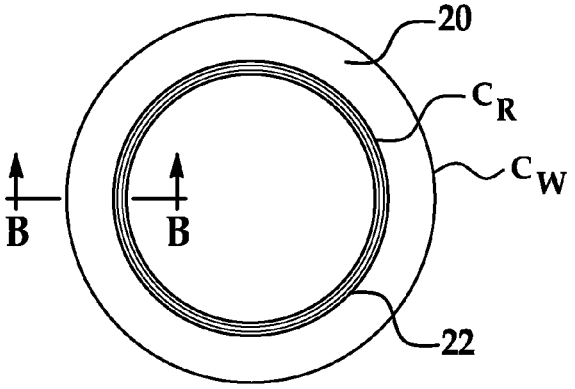
FIG. 3 is a top view of the beverage container of FIG. 1.

The bottom wall 62 (shown in phantom in FIGS. 2, 8 and 9) can have any suitable geometric configuration. In the embodiment set forth in the drawing figures, the bottom wall 62 has an inwardly curved geometry having a lowest region proximate to arm member 56 and a maximum inwardly oriented point proximate to the radial center of the device 10. The arc defined by curved bottom wall 62 is between 1 degree and 30 degrees from planar.

Engagement between rim 22 and the arm member 56 generally occurs at a junction point located at a lower portion of detent 60 and rounded shoulder region 50 of the respective elements. While the present disclosure has presented engagement between two beverage containers 10, it is also considered within the purview of the present disclosure to provide releasable engagement between a beverage container 10 and a suitable accessory.

Figure 13:
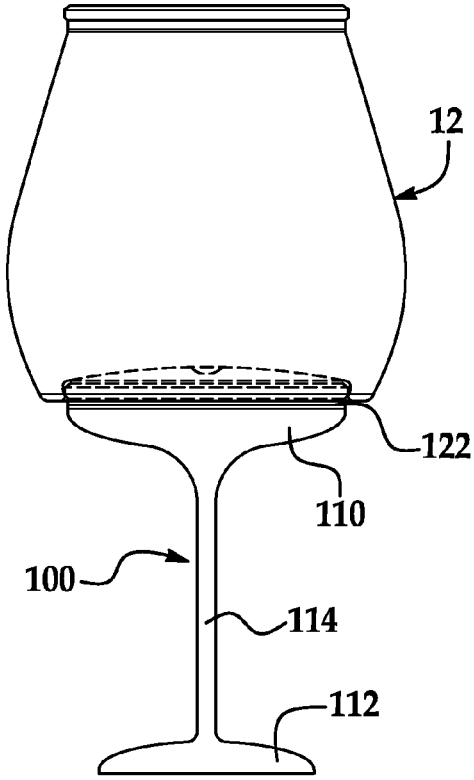
FIG. 13 is a side view of a beverage container as disclosed herein as an assembly with an embodiment of a removable beverage container accessory.
Figure 14:
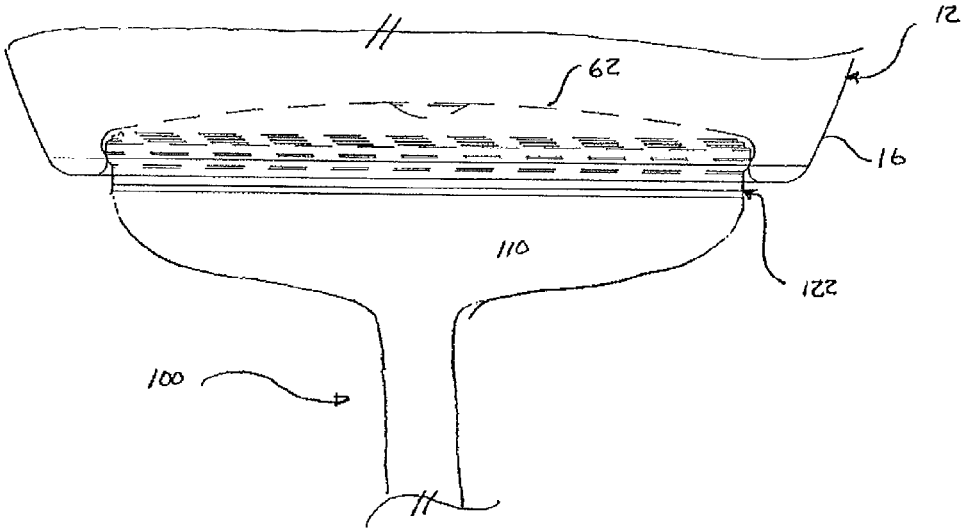
FIG. 14 is a detail view of the assembly of FIG. 13.

One non-limiting example of a suitable accessory is wine glass stem 100 depicted in FIGS. 13 and 14. Wine glass stem 100 includes a suitable head 110, base 112 and stem 114 interposed between head 110 and base 112. Head 110 is configured to releasably engage a suitably configured base 16 of beverage container 10. In the embodiment depicted, head 110 of wine glass stem 100 includes a suitable rim 122 configured to matingly contact arm member(s) 56. In the embodiment illustrated, rim 122 is matingly received in the orifice defined by continuous circular arm member 56 in the manner described previously. Other accessories are contemplated, including but not limited to Pilsner stems as well as plate members and the like.

When the beverage container 10 is employed with an accessory such as wine glass stem 100, the stem 100 can be attached when desired. Typically the stem 100 will be attached to base 16 of beverage container 100 prior to removal of lid 14.

Figure 11:
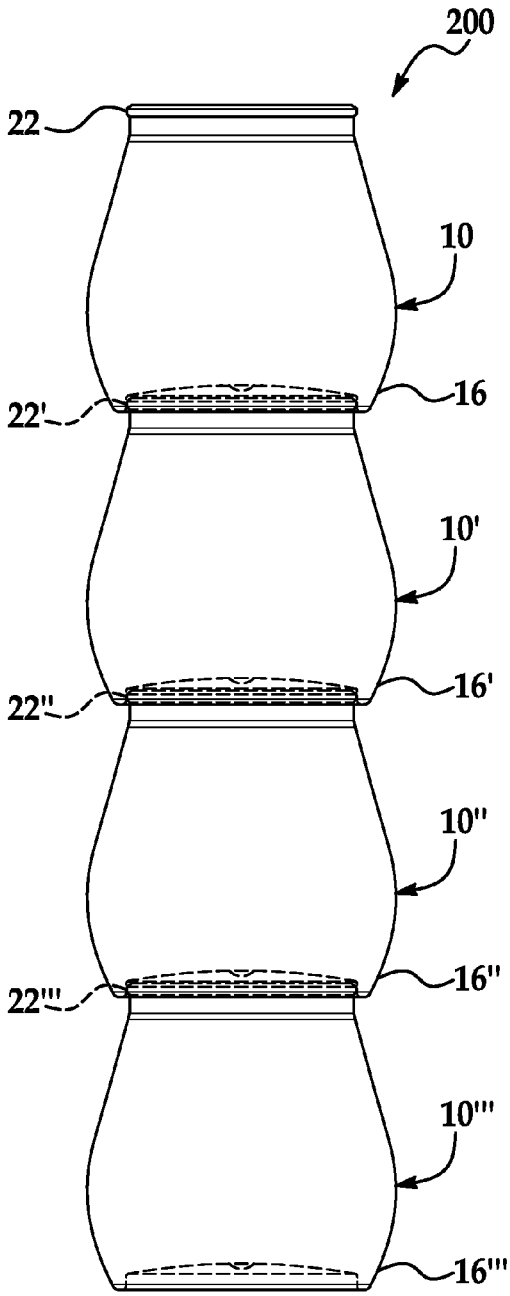
FIG. 11 is a side view of an embodiment of a beverage container assembly of FIG. 10.
Figure 12:
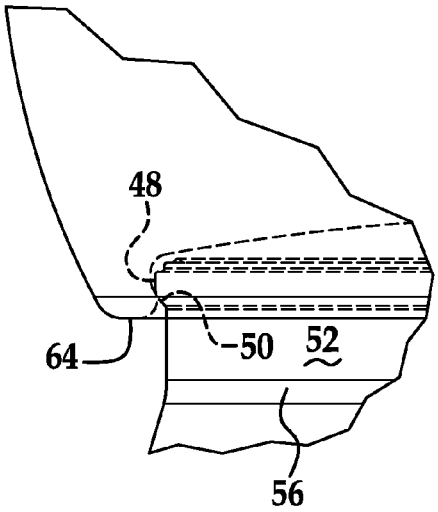
FIG. 12 is a detail view of the junction between two of the beverage containers in the beverage container assembly of FIG. 10.

The present disclosure also contemplates an assembly of beverage containers such as those previously described the assembly including at least two beverage containers each having a vessel body 12 and a lid 14. Each beverage container 10 has a serving of a given beverage located in a sealed chamber defined in the vessel body 12. The serving size can be a predetermined amount. In applications where the beverage container 10 is configured to contain wine, the serving size can be between 2 oz. and 6 oz. by way of example. In the assembly 200, as depicted in FIGS. 11 and 12, the base 16 of at least one first beverage container 10 releasably engages the rim 22' of a second beverage container 10' such that a lid 14' of the second beverage container 10' is interposed between the respective rim 22' and base 16.

Figure 15A:
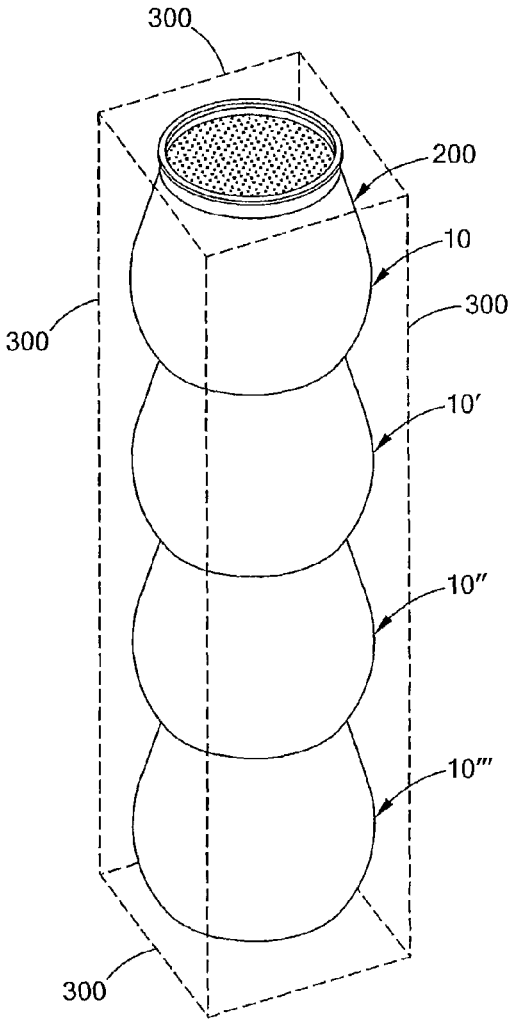
FIG. 15A is a perspective view of the beverage container assembly of FIG. 11 when encompassed by a box.
Figure 15B:
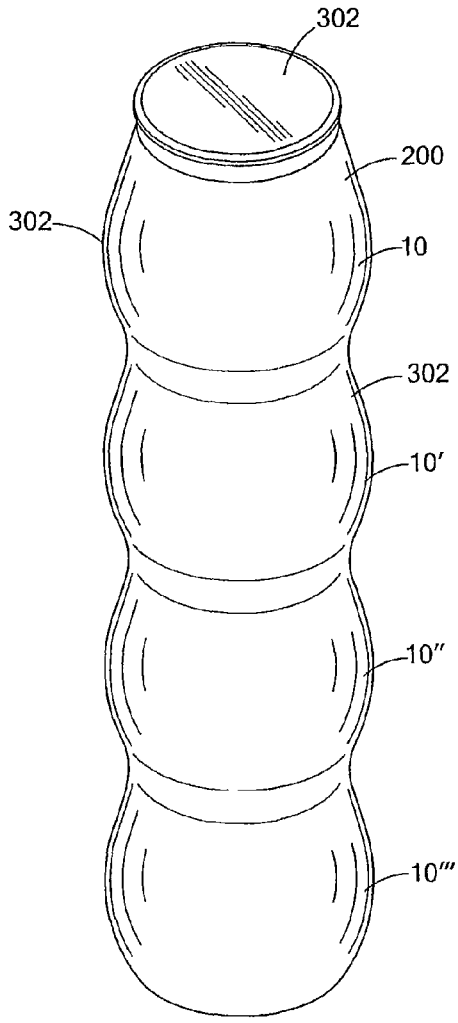
FIG. 15B is a perspective view of the beverage container assembly of FIG. 11 when encompassed by a shrink wrap.

The assembly 200 can be composed of any number of beverage containers 10, 10'. Certain assemblies can be composed of even multiples of beverage containers with assemblies of two and four being typical in certain applications. The assembly 200 can further include an outer covering member as shown in FIGS. 15A and 15B. Non-limiting examples of an outer covering include boxes (FIG. 15A) and shrink wrap (FIG. 15B) and the like. Note that the shape and dimensions of the box 300 shown in FIG. 15A (see dashed lines) and the shrink wrap 302 shown in FIG. 15B are not meant to depict particular shapes and dimensions. They are shown for depicting the general idea of using a box or shrink-wrap to contain the assembly 200 and, thus, are for illustrative purposes only.

Figure 16B:
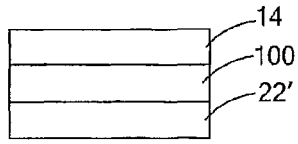
FIG. 16B schematically shows a material that adheres to a seal region of a beverage container of FIG. 10.

The beverage containers 10, 10' etc. can be dimensioned to approximate the height and maximum width dimensions of a standard wine bottle. Thus an assembly 200 of four beverage containers 10, 10', 10'', 10''' positioned in stacked end-to-end relationship will have the approximate height of a standard wine bottle. The assembly can contain four servings of the same or different wines. Each container can be accessed by removing the respective lid. The contents can be consumed from the opened beverage container which can be used as a drinking glass. Note that a possible attachment of a lid to rim 22 of FIG. 11 via an adhesive 100 is schematically shown in FIG. 16A and a possible attachment of a lid to rim 22' of FIG. 11 via an adhesive 100 is schematically shown in FIG. 16B. Note that adherence of the adhesive material 100 is schematically shown in FIGS. 16A-B wherein the items shown in FIGS. 16A-B are not meant to be limited to a particular shape or dimension.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An assembly comprising:

a first beverage container comprising:

a first vessel body, the first vessel body comprising:

a first base having a first perimeter;

a first side wall connected to the first base; and a first rim defined on the first side wall distal to the first base, the first side wall comprising a side wall median and a central section having a maximum circumference greater than a circumference of the first base, the maximum circumference located at a position on the first side wall between the side wall median and the first base; and a first lid having a first seal region, the first seal region removably attached to the first rim;

a first material that adheres to the first seal region and the first rim so that the first seal region is removably attached to the first rim; and a second beverage container comprising:

a second vessel body, said second vessel body comprising:

a second base having a second perimeter;

a second side wall connected to the second base; and a second rim defined on the second side wall distal to the second base, wherein the second rim is releasably attached to the first base of the first beverage container such that a second lid of the second beverage container is interposed between the rim of the second beverage container and the base of the first beverage container; and the second lid having a second seal region, the second seal region removably attached to the second rim; and a second material that adheres to the second seal region and the second rim so that the second seal region is removably attached to the second rim.

2. The assembly of claim 1 wherein the first base of the first beverage container comprises a bottom surface and an arm member extending downward from the first side wall, the arm member comprising:

an inwardly oriented side;

an outwardly oriented side;

a surface contacting region; and a detent region defined on the inwardly oriented side.

3. The assembly of claim 2 wherein the first rim comprises a plurality of ridge members oriented on the first rim in spaced annular parallel relationship to one another.

4. The assembly of claim 2 wherein the first beverage container and the second beverage container each include a serving of wine.

5. The assembly of claim 2 further comprising a covering member.

6. The assembly of claim 5 wherein the covering member is selected from the group consisting of shrink wrap and a box.

7. The assembly of claim 2, wherein the first base comprises an inwardly concave surface and the detent region is located between the surface contacting region and the bottom surface.

8. The assembly of claim 2, wherein the first side wall has a cylindrical portion and the arm member extends around a lower periphery of the first side wall.

9. The assembly of claim 3, wherein the first lid has a region configured to sealingly conform to at least one of the plurality of ridge members.

10. The assembly of claim 2, wherein the first rim comprises a plurality of ridge members oriented on the first rim in spaced annular parallel relationship to one another.

11. The assembly of claim 1, wherein a liquid is present within an interior of the first vessel body, wherein when the first lid is completely sealed to the first rim the liquid directly contacts the first vessel body.

12. The assembly of claim 1, wherein a liquid is present within an interior of the second vessel body, wherein when the second lid is completely sealed to the second rim the liquid directly contacts the second vessel body.

13. The assembly of claim 1, wherein the first vessel body is identical in shape to the second vessel body.

14. The assembly of claim 2, wherein the second rim releasably engages a portion of the detent region.

15. The assembly of claim 2, wherein releasable attachment between the second rim and a portion of the detent region is accomplished by the second rim contacting the portion of the detent region.

* * * * *